US008665924B2

(12) United States Patent
Koenig et al.

(10) Patent No.: US 8,665,924 B2
(45) Date of Patent: Mar. 4, 2014

(54) ELECTRONIC CIRCUIT AND METHOD OF SUPPLYING ELECTRICITY

(75) Inventors: Roland Koenig, Duisburg (DE); Thomas Pasch, Erkrath (DE); Andreas Haaks, Rheinberg (DE); Rolf Degel, Im Laar (DE)

(73) Assignee: SMS Siemag Aktiengesellschaft, Duesseldorf (DE)

( * ) Notice: Subject to any disclaimer, the term of this patent is extended or adjusted under 35 U.S.C. 154(b) by 1101 days.

(21) Appl. No.: 11/665,435

(22) PCT Filed: Jul. 24, 2006

(86) PCT No.: PCT/EP2006/007247

§ 371 (c)(1),
(2), (4) Date: Apr. 13, 2007

(87) PCT Pub. No.: WO2007/019943

PCT Pub. Date: Feb. 22, 2007

(65) Prior Publication Data

US 2008/0123714 A1 May 29, 2008

(30) Foreign Application Priority Data

Aug. 15, 2005 (DE) ..... 10 2005 038 702

(51) Int. Cl.
*H05B 7/148* (2006.01)

(52) U.S. Cl.
USPC ..... 373/104; 373/47; 219/130.1

(58) Field of Classification Search
USPC ..... 373/47, 60, 102, 104, 108; 219/130.1, 219/501; 323/353
See application file for complete search history.

(56) References Cited

U.S. PATENT DOCUMENTS

| | | | | |
|---|---|---|---|---|
| 5,239,554 | A | 8/1993 | Gensini et al. | 343/102 |
| 5,991,327 | A * | 11/1999 | Kojori | 373/104 |
| 6,603,795 | B2 * | 8/2003 | Ma et al. | 373/102 |

FOREIGN PATENT DOCUMENTS

| | | |
|---|---|---|
| DE | 972 422 | 10/1956 |
| DE | 972422 | 10/1956 |
| DE | 2 034 874 | 1/1972 |
| DE | 2034874 | 1/1972 |
| EP | 0 429 774 | 6/1991 |
| EP | 0429774 | 6/1991 |

(Continued)

OTHER PUBLICATIONS

Machine translation of DE 972422.*

(Continued)

*Primary Examiner* — Brian Jennison
(74) *Attorney, Agent, or Firm* — Andrew Wilford

(57) ABSTRACT

The invention relates to an electronic circuit and a method for feeding power to at least one electrode of an alternating-current electric-arc furnace, particularly for melting metal. Known circuits of this type typically comprise a series connection with a transformer for providing a supply voltage for the electric-arc furnace from a power grid (1) and a AC power controller (8) connected between the transformer (6) and the electrode (11) for regulating the current through the electrode (11). According to the invention, a further development for such electronic circuits is proposed, which development has a simple design, is inexpensive and prevents overload of the AC power controller (8) even in operating modes of the electric-arc furnaces at high electrode currents. This further development provides to bypass the AC power controller with a bypass switch (9) that is opened or closed with the help of a controller as a function of the amount of current flowing through the electrode (11).

7 Claims, 3 Drawing Sheets

(56) References Cited

FOREIGN PATENT DOCUMENTS

| | | |
|---|---|---|
| EP | 0589 544 | 3/1994 |
| EP | 0589544 | 3/1994 |
| JP | 49-3141 | 1/1974 |
| JP | 49-129931 | 12/1974 |
| JP | 59-115211 | 1/1983 |
| JP | 2004-334623 | 11/2004 |
| WO | WO 02/063927 | 8/2002 |
| WO | WO-02063927 | 8/2002 |

OTHER PUBLICATIONS

Machine translation of EP 0 589 544.*
Machine Translation of DE 2 037 874.*

* cited by examiner

ELECTRONIC CIRCUIT AND METHOD OF SUPPLYING ELECTRICITY

CROSS REFERENCE TO RELATED APPLICATIONS

This application is the US national phase of PCT application PCT/EP2006007247, filed 24 Jul. 2006, published 22 Feb. 2007 as WO2007/019943, and claiming the priority of German patent application 102005038702.0 itself filed 15 Aug. 2005, whose entire disclosures are herewith incorporated by reference.

FIELD OF THE INVENTION

The invention relates to an electronic circuit and a method for supplying energy to at least one electrode of an alternating-current electric-arc furnace, particularly for melting metal with energy.

The invention can be used for electric-arc furnaces for the production of nonferrous metals, iron alloys, process slags, and steel, as well as for cleaning the slag. The electric-arc furnaces can be configured as electric reduction furnaces, as electric low-shaft furnaces or as arc furnaces.

BACKGROUND OF THE INVENTION

An electronic circuit of this type for powering an alternating-current electric-arc furnace is known from German unexamined patent application DE 2 034 874. The electronic circuit disclosed there is connected between a power grid and at least one electrode of the electric-arc furnace. It comprises a series connection with an on/off switch for the electric-arc furnace, a transformer for providing a supply voltage for the electric-arc furnace from the power grid and an AC power controller connected between the transformer and the electrode for regulating the current to the electrode.

An AC power controller typically comprises two thyristors connected antiparallel and regulating the current by phase angle control. The thyristors, which represent the power part of the controller, are typically designed for the entire operating range of the electric-arc furnace, meaning a very wide power range. Particularly in the case of powerful furnaces that are operated with high supply voltages, generally very expensive models of thyristor are required due to the high thyristor reverse voltages. However thyristors with high reverse voltages generally cannot control high currents; for controlling high currents, like those occurring certainly in some operational states, particularly a resistance state, of the electric-arc furnace, therefore a plurality of individual thyristors or complete AC power controllers must be connected in parallel. Only this way can the high electrode currents required at least in some operational states be achieved. To guarantee reliable operation of the electric-arc furnace in all operational states, even with high electrode currents, therefore traditionally expensive and complex converter circuits are required.

Object of the Invention

Starting from this state of the art, it is the object of the invention to further design a known electronic circuit and a method for feeding electric power to an alternating-current electric-arc furnace through such simple and inexpensive design measures that the electric-arc furnace can be operated without difficulty in all operational states, particularly also with high electrode currents.

SUMMARY OF THE INVENTION

According to the invention, an electronic circuit for feeding an alternating-current to an electric-arc furnace is characterized by means for measuring the amount of current flowing through the electrode, a bypass switch connected parallel to the AC power controller, and a controller for opening or closing the bypass switch as a function of the amount of current flowing through the electrode.

The described characterizing features can therefore be implemented easily and consequently inexpensively. In the inventive configuration, they advantageously allow the AC power controller to be bypassed in the event of imminent overload, meaning during operational states of the electric-arc furnace that require particularly high electrode current. Advantageously, these operational states, such as a resistance state with submerged electrodes and without electric arc, require no special regulation of the electrode current by the AC power controller; its function is then dispensable and is then bypassed. During other operational states of the electric-arc furnace, for example during a resistance mode with electric arc, the bypass switch is opened according to the invention, as a result of which the electrode current is conducted via the AC power controller and can be controlled by same. The amount of current flowing through the electrode during operation with arc is typically lower than that during resistance mode without arc.

As a result of the current limitation by the AC power controller achieved as a result of the bypass switch according to the invention, the controller can advantageously be dimensioned considerably smaller and produced more cost-efficiently, without resulting in any restrictions regarding the operation of the electric-arc furnace.

Providing additional isolating switches directly upstream and downstream of the AC power controller, but still between the connections of the bypass switch, offers the advantage that, when the bypass switch is closed, meaning when the AC power controller is bypassed, the controller can be removed from the electronic circuit, for example for maintenance purposes, without having to is interrupt the electrode current and the operation of the electric-arc furnace.

By providing the bypass switch according to the invention, the electronic circuit is adapted easily and inexpensively to varying operational states of the electric-arc furnace, like those resulting from metallurgical requirements.

The above object is furthermore achieved by a method according to the invention for feeding electric power to an alternating-current electric-arc furnace, or the electrode thereof. The advantages of this method correspond to the advantages mentioned above with reference to the electronic circuit.

BRIEF DESCRIPTION OF THE DRAWING

Advantageous embodiments of the electronic circuit as well as of the method are disclosed in the dependent claims.

A total of four figures are attached to the description, wherein.

SPECIFIC DESCRIPTION

The invention will be explained in more detail hereinafter with reference to the illustrated embodiments that are illustrated in the figures.

Typically, electric-arc furnaces with three or six electrodes are used for melting steel. In the case of furnaces with six electrodes, the electrodes 11 are connected in pairs for supplying the furnace vessel 12 with power. In the case of electric-arc furnaces with three electrodes 11, the electrodes are usually connected in a knapsack circuit to lower the reactance of the high-current line. Alternatively to the knapsack circuit, however, a star connection of the electrodes is also possible.

Figure 1:
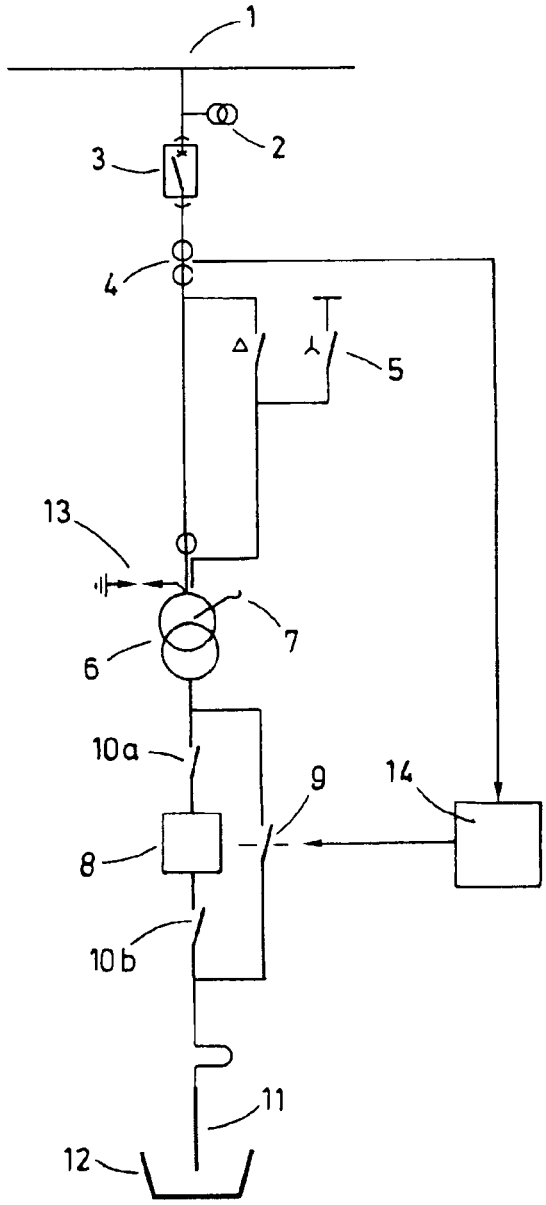
FIG. 1 shows the electronic circuit according to the invention.

FIG. 1 shows the electronic circuit according to the invention for feeding electric power to the electric-arc furnace. FIG. 1 is a monophase illustration; corresponding circuits could also be provided for additional phases.

The power for the electric-arc furnace is typically supplied from a medium voltage grid 1. Between the medium voltage grid 1 and the electrode 11, the electronic circuit comprises a furnace transformer 6 whose primary faces the medium voltage grid 1, hereinafter referred to as the power grid, and whose secondary faces the electrode 11. Between the power grid 1 and the primary of the furnace transformer 6, the electronic circuit comprises a first series connection of a voltage meter device 2, a furnace power switch 3 for turning the electric-arc furnace on or off, a current meter 4, optionally a star-delta switch for selectively connecting the primary winding of the furnace transformer in a star or delta connection, as well as a surge protector 13. The star-delta switch allows a shift of the measuring voltage range of the furnace transformer 6 up or down, for example by a factor of 1.73.

Between the secondary of the furnace transformer 6 and the electrode 11, the electronic circuit substantially comprises a second series connection of a first isolating switch 10*a*, an AC power controller 8, and a second isolating switch 10*b*. When a high current isolating switch 9 is closed, the isolating switches 10*a* and 10*b* allow electric isolation and/or disassembly of the AC power controller 8, for example for maintenance work, without having to interrupt operation of the furnace, particularly the resistance operation with submerged electrodes and without arc. The AC power controller 8 allows the electrode current to be regulated by phase angle control.

According to the invention, the electronic circuit is supplemented with the bypass switch 9 connected in parallel to the AC power controller 8 and optionally also in parallel to the first and second isolating switches 10*a* and 10*b* and controlled by a controller 14 that regulates the bypass switch 9 as a function of the amount of current flowing through the electrode 11 measured by the current meter device 4. The controller 14 can be a programmable controller, a process control system or another computer-based system.

After setting up the electronic circuit, the function of the electric-arc furnace in interaction with the electronic circuit according to the invention will be described in more detail.

Figure 2:
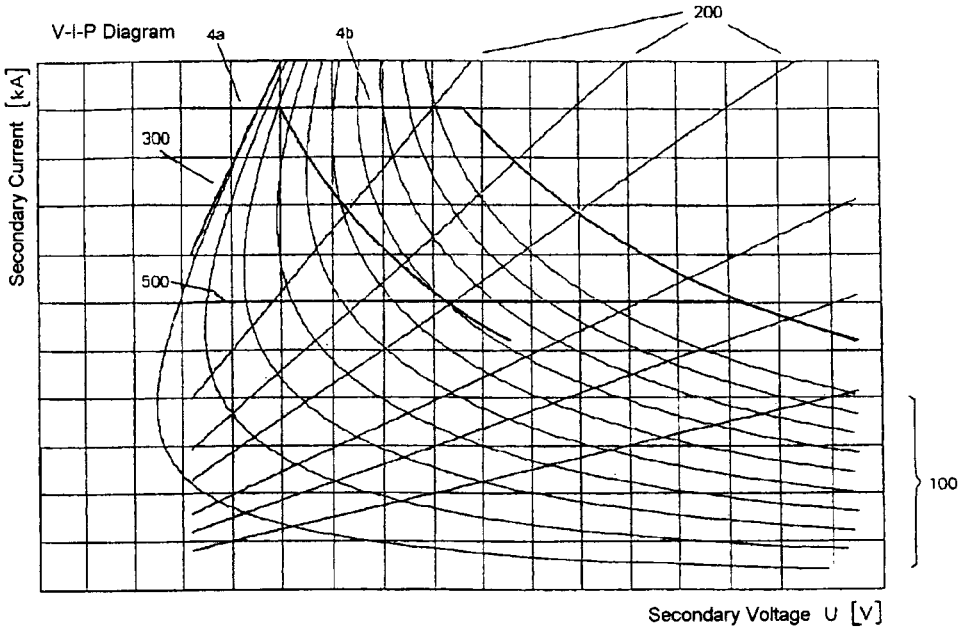
FIG. 2 shows a typical voltage-current-power (VIP) diagram for an electric-arc furnace.

FIG. 2 shows a typical voltage-current power (VIP) diagram for an electric reduction furnace with 6 electrodes. In this diagram, the effective power lines 100 are shown as a function of the secondary currents that are plotted on the ordinate, and the secondary voltages that are plotted on the abscissa. The family of lines 200 denotes the furnace resistance. The short-circuit impedance of the electric-arc furnace is symbolized by the line 300. These characteristic lines in the diagram apply only to a constant thyristor firing angle. If the firing angle is larger or smaller, the lines will shift across the abscissa.

The characteristic lines 4*a* and 4*b* show the maximum permissible current through the electrode as a function of the secondary voltage with a star connection of the transformer windings 4*a* on the primary and a delta connection of the transformers of the transformer windings 4*b* on the primary. The line 500 illustrates the maximum rated current of the AC power controller 8 according to the invention, meaning the current threshold value.

Typically, depending on the process, materials used and products, substantially the following metallurgical operational states can be differentiated in an electric-arc furnace:

a) resistance operation with submerged electrodes and without arc;

b) resistance operation with little arc; and c) operation with high arc.

These three operational states will be explained in more detail hereinafter:

Resistance Operation with Submerged Electrodes and without Arc

The power required for the process is produced by means of resistance heating of the slag. The electrodes 11 are clearly submerged in the slag, the immersion depth depends, among other things, on the electrode diameter, however it is typically greater than 200 mm. In this operating mode, electric current is conducted through the slag, thus converting electric power by the joule effect into heat due to the electrical resistance of the slag, which drives a metallurgical endothermic reaction, for example a reduction and melting. The resistance operation with submerged electrodes and without arc is characterized by high electrode currents and relatively low secondary voltages that are clearly below 1000 V.

In this operating mode, no special control requirements exist due to the submerged electrodes. The electric-arc furnace can therefore also be operated conventionally, meaning without current control. During this type of operation, it is therefore recommended to close the bypass switch 9 and thus bypass the AC power controller 8. This way, the power semiconductors, typically thyristors, are protected in the AC power controller 8 from excessive currents.

Resistance Operation with Little Arc

The majority of power required for this type of operation of the electric-arc furnace is produced by means of resistance heating of the slag. Electric current is conducted through the slag, thus converting the electric power into heat by the joule effect as a result of the resistance of the slag.

Figure 4:
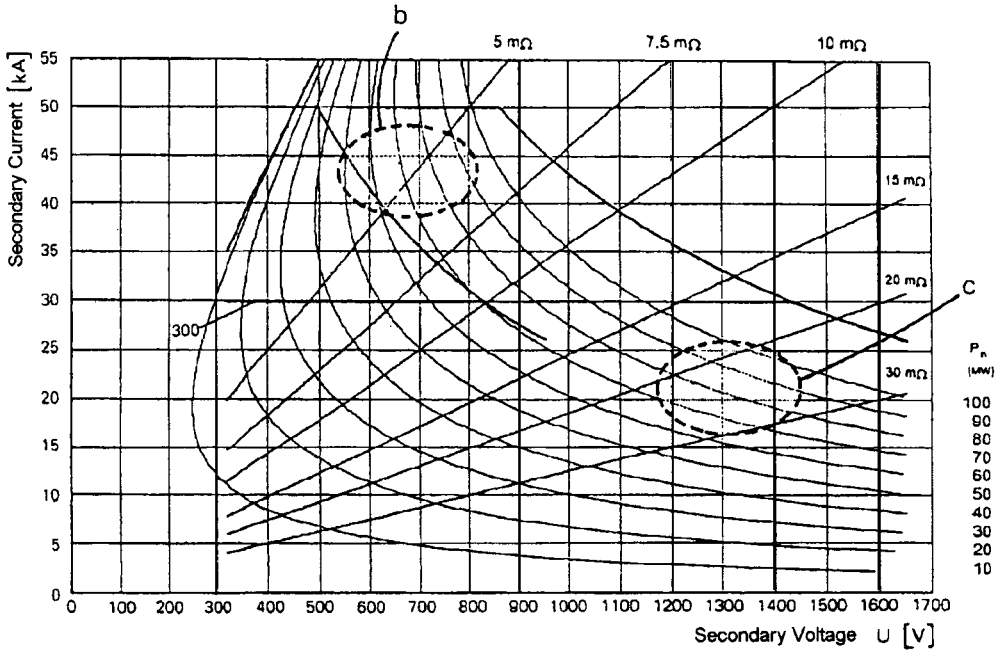
FIG. 4 is the diagram according to FIG. 2 with additional, different operating ranges of the electric-arc furnace and current threshold.

The Joule effect drives a metallurgical endothermic reaction, for example a reduction and melting. An additional smaller amount of energy supplied can also be effected by an electric-arc occurring in the lower region of the electrodes or beneath them. This is only possible for minimally submerged electrodes or with an electrode positioned directly over the slag bath. For this operating mode, typically relatively high current strengths and comparatively low voltages are required; see FIG. 4, area b). However, the voltages with this operating mode are typically higher than in the case of submerged electrodes. Basically, the secondary voltages are typically in a range around 1000 V for 30-50 MW furnaces.

Resistance Operation with High Arc

In this operating mode, the majority of power supplied occurs via the arcs. The arcs transmit their radiant heat directly to the batch and slag layers of the furnace. A differentiation is made in principle between arc operation in the open and operation with a covered arc.

Figure 3:
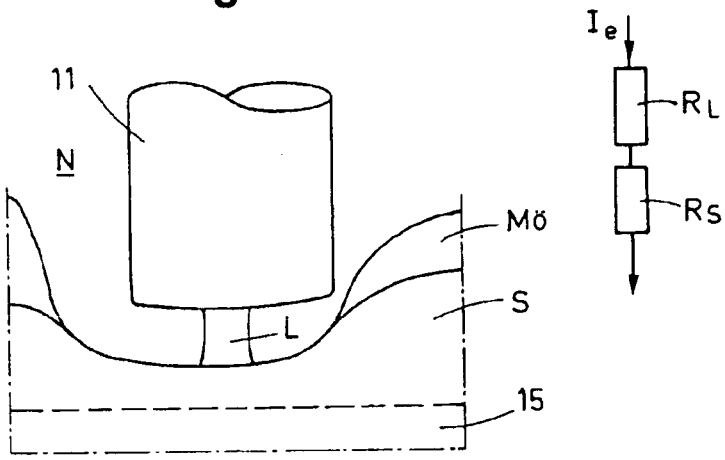
FIG. 3 is a cross-section of the electrode and melt in an electric-arc furnace as well as the associated electric equivalent circuit for this part of the electrode current.

During operation with arcs in the open, the electric-arc impinges upon the burden Mö and/or the slag S without usage of the lateral radiant heat; see FIG. 3, wherein N represents the region of the arc in the open. FIG. 3 also shows an electric equivalent circuit for the electric path through the electrode 11, the arc L, the slag S and the liquefied metal 15. In an idealized illustration, the ohmic resistance of the electrode 11 and of the liquefied metal 15 can be assumed to be zero. For the electrode current this means ohmic resistance RL due to the arc L and ohmic resistance $R_s$ through the slag S.

During operation with covered arcs, the marginal region of the electrode 11 is covered in part by the burden Mö; see FIG. 3, the right edge of the electrode. In addition to the electric-arc energy, a substantially equal or smaller portion of the power supplied to the electrodes is fed by means of resistance heating. For the above-described operating mode with high arc, typically lower currents at high voltages are required; see FIG. 4, area c).

The voltages in furnaces above 30-50 MW typically exceed 1000V. High demands are placed on electrode current control due to the non-linear and stochastic behavior of the arcs with a tendency toward instability. In the case of the operating mode c), the entire electrode current that is required is conducted and regulated via the AC power controller 8. The high current isolating switch 9 is open in this case.

The transition between operating modes b) and c) is continuous. In principle it is true that the bypass switch 9 is only opened and the first and second isolating switches 10*a*, 10B are closed as the power increases as a result of increased secondary voltage of the transformer 6, as the portion of the arc L in the amount of energy supplied increases, see FIG. 3, and as the current threshold 300 for the electrode current is no longer met. This way, the AC power controller is connected and serves to optimize the energy input. Vice versa, the AC power controller 8 must be removed again from the electric circuit in a timely fashion when the energy supplied from the arc decreases, the secondary voltage decreases and the electrode current increases, meaning in principle when the current threshold value through the electrode current is exceeded. In principle, the current threshold value 300 required for opening the bypass switch 9 is identical to the current threshold value required for closing the bypass switch. However, for both processes also different current threshold values are conceivable, for example combined in a hysteresis configuration.

Equivalent to FIG. 2, FIG. 4 shows an example for the dimensioning of the electronic circuit according to the invention for feeding power to an electric-arc furnace with six electrodes for an FeNi process with 129 MVA. As is true for FIG. 2, the characteristic line 300 denotes the maximum current through the AC power controller 8 and hence the current threshold value for switching the bypass switch 9. The AC power controller 8 is closed when the electrode currents exceed this threshold value, thus removing the electric load from the AC power controller. This has the advantage that the AC power controller 8 overall and in particular the power semiconductors thereof can be dimensioned considerably smaller, thus providing a simple and inexpensive solution.

Even if the electric-arc furnaces, particularly electric reduction furnaces, are configured for the operating modes b) and c), they can still be operated in the ranges of a start-up operation and a partial load operation with a closed bypass switch 9, meaning with bypassed AC power controller 8.

The invention claimed is:

1. An electronic circuit for feeding electric power to at least one electrode of an alternating-current electric-arc furnace, the circuit comprising:

a transformer for providing a supply voltage for the electric-arc furnace from a power grid;

an AC power controller connected in series between the transformer and the electrode for regulating the current through the electrode;

means for measuring the amount of current flowing through the electrode;

a bypass switch connected in parallel to the AC power controller and closable to form a short circuit; and a controller for opening or closing the bypass switch and routing current around the AC power controller when the current flowing to the electrode and measured by the means exceeds a predetermined threshold.

2. The electronic circuit according to claim 1, further comprising:

a first isolating switch connected between the transformer and the AC power controller and a second isolating switch connected between the AC power controller and the electrode.

3. The electronic circuit according to claim 2 wherein the bypass switch is connected such that it bypasses the series connection of the first isolating switch, the AC power controller and the second isolating switch.

4. A method of feeding electric power to at least one electrode of an alternating-current electric-arc furnace, the method comprising the following steps:

providing a supply voltage for the electric-arc furnace from a power grid;

regulating the current through the electrode with the help of an AC power controller;

measuring the amount of current flowing through the electrode; and to bypassing the AC power controller by a short-circuit connection when the current measured exceeds a predetermined threshold value.

5. The method according to claim 4, further comprising the step of:

operating the electric-arc furnace in a start-up mode, a heat retention mode or a resistance mode without arc when the current exceeds the current threshold value.

6. The method according to claim 4, further comprising the step of:

operating the electric-arc furnace in a resistance mode with arc when the amount of current drops below the current threshold value.

7. A method according to claim 4, further comprising the step of:

disconnecting the AC power controller, when bypassed, for supplying energy to the electrode as the electric-arc furnace is being operated.

* * * * *